US005315230A

United States Patent [19]

Cordoba et al.

[11] Patent Number: 5,315,230

[45] Date of Patent: May 24, 1994

[54] TEMPERATURE COMPENSATED VOLTAGE REFERENCE FOR LOW AND WIDE VOLTAGE RANGES

[75] Inventors: Michael V. Cordoba; Kim C. Hardee; Douglas B. Butler, all of Colorado Springs, Colo.

[73] Assignees: United Memories, Inc., Colorado Springs, Colo.; Nippon Steel Semiconductor Corp., Japan

[21] Appl. No.: 940,084

[22] Filed: Sep. 3, 1992

[51] Int. Cl.[5] ..... G05F 3/16

[52] U.S. Cl. ..... 323/313; 323/907

[58] Field of Search ..... 323/313, 314, 315, 907

[56] References Cited

U.S. PATENT DOCUMENTS

| | | | |
|---|---|---|---|
| 3,522,521 | 8/1970 | Lloyd | 323/313 |
| 3,828,241 | 8/1974 | Horichi | 323/313 |
| 4,009,432 | 2/1977 | Dingwall et al. | 323/267 |
| 4,037,120 | 7/1977 | Colardelle et al. | 323/315 |
| 4,645,998 | 2/1987 | Shinohara et al. | 323/313 |
| 4,686,449 | 8/1987 | Jeffrey et al. | 323/313 |
| 5,117,177 | 5/1992 | Eaton, Jr. | 323/314 |
| 5,121,049 | 6/1992 | Bass | 323/907 |
| 5,134,310 | 7/1992 | Mobley et al. | 307/270 |

FOREIGN PATENT DOCUMENTS

| | | | |
|---|---|---|---|
| 3704609A1 | 8/1987 | Fed. Rep. of Germany | G05F 3/24 |
| 4038319A1 | 6/1991 | Fed. Rep. of Germany | H01L 23/58 |

OTHER PUBLICATIONS

Horiguchi et al., "A Tunable CMOS-DRAM Voltage Limiter with Stabilized Feedback Amplifier", *IEEE Journal of Solid-State Circuits*, vol. 25, No. 5, pp. 1129-1134 (Oct. 1990).

Michejda et al., "A Precision CMOS Bandgap Reference," *IEEE Journal of Solid-State Circuits*, vol. sc-19, No. 6, pp. 1014-1021 (Dec. 1984).

*Primary Examiner*—J. L. Sterrett

*Attorney, Agent, or Firm*—Edward D. Manzo

[57] ABSTRACT

A reference voltage generator which compensates for temperature and $V_{CC}$ variations includes a constant current source and a MOS P-channel transistor. The constant current source provides a constant current over a wide range of $V_{CC}$ that corresponds to biasing a p-channel transistor in a region where its resistance is constant. The output of the current source is supplied to the P-channel transistor, which is in saturation. The constant current provides a constant voltage drop across the P-channel transistor. Hence, a stable reference voltage is generated. Temperature compensation is provided by biasing the P-channel transistor to saturation and supplying a constant current that the corresponds to biasing a p-channel transistor where the resistance is substantially constant over a temperature range. The current causes a voltage drop across the P-channel transistor to maintain a stable reference voltage. Also, temperature compensation is further provided by utilizing the negative temperature coefficients of the resistors included in the constant current source.

19 Claims, 3 Drawing Sheets

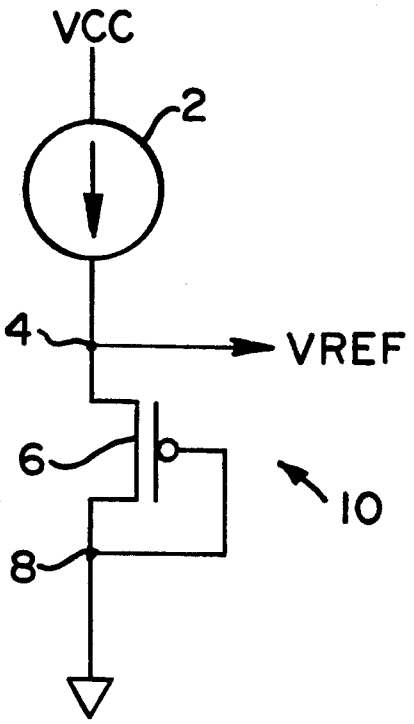
FIG. 1
FIG. 2
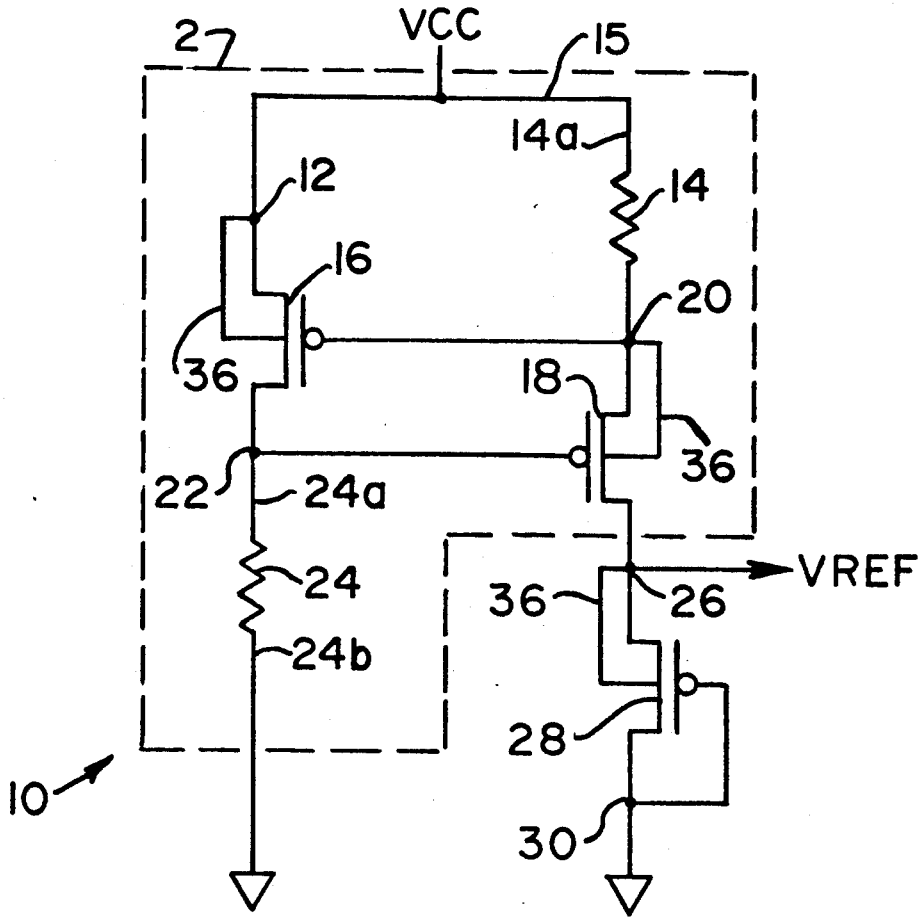

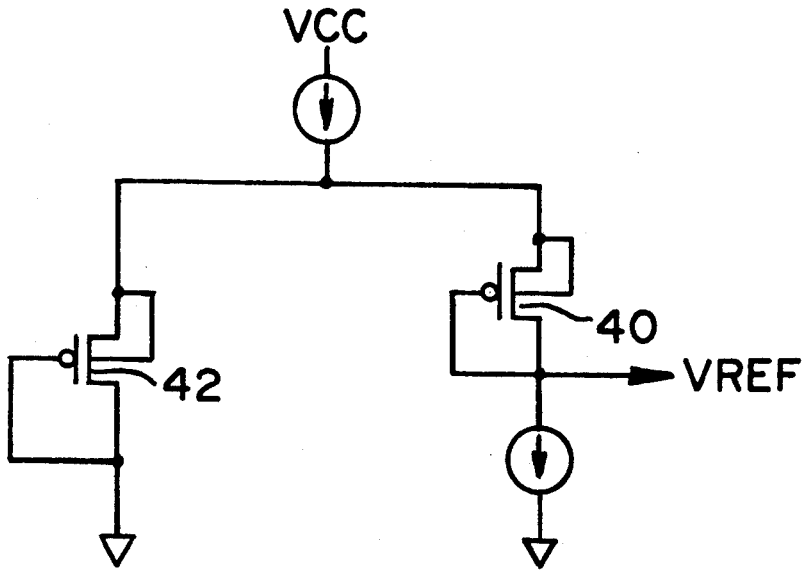
FIG. 5
PRIOR ART
FIG. 6
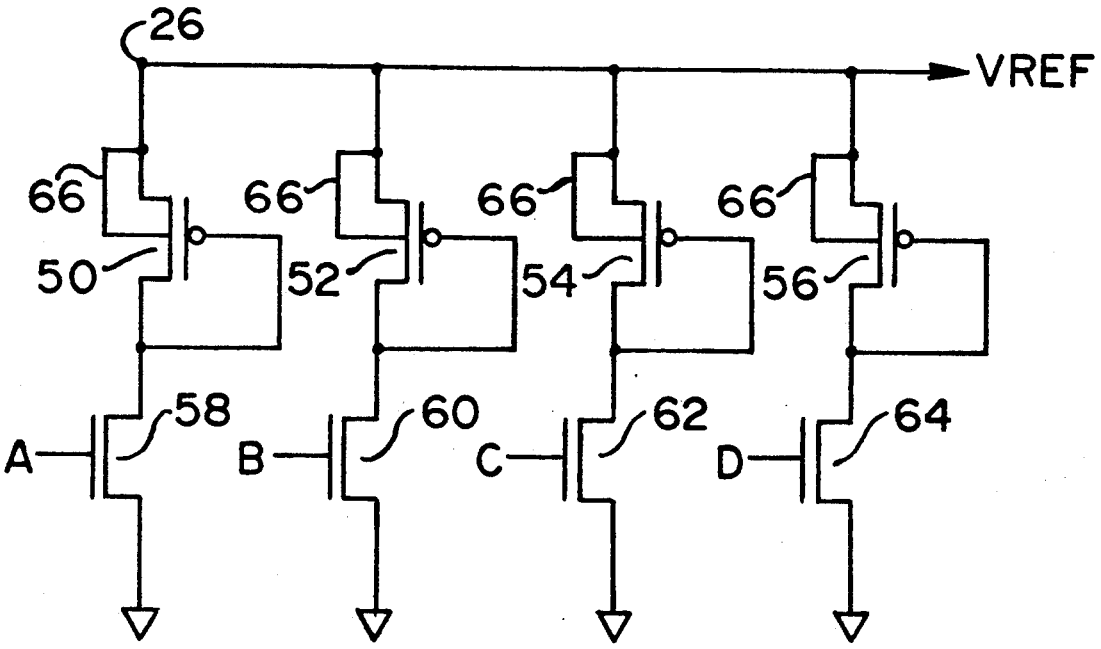

TEMPERATURE COMPENSATED VOLTAGE REFERENCE FOR LOW AND WIDE VOLTAGE RANGES

FIELD OF THE INVENTION

The present invention relates to a reference voltage generator and more particularly to a metal oxide semiconductor ("MOS") temperature compensated reference voltage generator for low and wide voltage ranges for use on integrated circuitry.

BACKGROUND OF THE INVENTION

Many electronic devices require a reference voltage to implement their design. The reference voltage may be used to control the electronic device or may, for example, be compared to another voltage. These uses require that the reference voltage remain stable. The challenge is to provide a reference voltage generator which gives a stable voltage despite temperature and power supply (voltage) variations, or others.

One type of device that is used to generate a reference voltage is a "bandgap" circuit. The bandgap circuit was originally developed for bi-polar technology. It has been modified for use with Complementary Metal Oxide Semiconductor ("CMOS") technology. Among the elements used to implement the modified bandgap circuit are transistors biased as diodes. This type of bias requires the P-N junctions of the transistors to be forward biased. This type of biasing is not well-suited for CMOS technology since any generation of substrate current may cause the bandgap circuit to latch-up. Manufacturers avoid this problem by using specially isolated wells in the semiconductor manufacture in order to collect the current.

Another reference voltage generator, as shown in FIG. 5, provides a reference voltage determined by the difference between the threshold voltages of transistors used in the device. Referring to FIG. 5, a transistor 40 has a threshold voltage $V_{T1}$ that is less than the threshold voltage $V_{T2}$ of transistor 42. $V_{REF}$ is calculated by the equation:

$$V_{REF}=V_{T2}-V_{T1}. \quad (1)$$

For example, if $V_{T1}=-1.6$ V and $V_{T2}=-0.6$ V, then $V_{REF}=+1.0$ V. In this example, both transistors are P-channel devices, and each has a respective threshold voltage.

However, most CMOS technologies readily provide P-channel MOS transistors on a chip with uniform, single $V_T$. Extra processing steps, such as masking and implanting, are needed to fabricate a P-channel transistor with another $V_T$. These extra steps add considerable expense to the fabrication of this second device and the resulting circuit.

It is the general object of this invention to overcome the above-listed problems.

Another object of the present invention is to allow the use of any standard CMOS or MOS processes, thereby to obviate extra or costly processing.

A further object of the present invention is to implement a reference voltage generator that works well at low voltages and despite wide voltage variations.

Still another object of the present invention is to provide a reference voltage generator that has low power consumption.

A salutary object of the present invention is to provide a reference generator which can be designed to have a positive, negative, or an approximately zero temperature coefficient.

SUMMARY OF THE INVENTION

In providing a stable reference voltage, a preferred embodiment of the present invention includes a constant current source and a MOS P-channel transistor. The constant current source is designed to provide a constant current over a wide range of $V_{CC}$. The output of the current source is supplied to a saturation biased P-channel transistor. The preferred embodiment is configured so that the current of the current source is constant as $V_{CC}$ varies, which causes the voltage drop across the P-channel transistor to be constant and hence provide the stable voltage reference.

To control voltage, temperature compensation is provided by supplying to the P-channel transistor a constant current that corresponds to the transistor's bias region where $V_{DS}$ (drain-to-source voltage) at 0° C. is substantially equal to $V_{DS}$ at temperatures up to and inclusive of, for example, 90° C. While operating the P-channel in this bias region, the transistor's resistance remains substantially constant for varying temperatures. With the resistance and current remaining substantially constant, it follows from Ohm's Law that $V_{REF}$ will remain substantially constant.

It will be understood that a novel and important aspect of the operation of such a voltage reference generator is the provision of a saturation biased P-channel transistor, a constant current corresponding to a transistor's bias region where $V_{DS}$ (drain-to-source voltage) is substantially equal over a temperature range, and the use of the temperature coefficients of the resistors used in the constant current source.

The invention also includes a method for generating a reference voltage preferably by controlling a first transistor from a first node; controlling a second transistor from a second node; controlling a third transistor by coupling its drain and control electrodes together; and supplying a constant current from the second transistor to the third transistor which generates a constant voltage drop across the third transistor, thereby generating a stable reference voltage.

BRIEF DESCRIPTION OF THE DRAWINGS

The invention, together with the objects and the advantages thereof, may be better understood by reference to the following detailed description taken in conjunction with the accompanying drawings of which:

FIG. 1 is a simplified diagram of a circuit embodying the present invention;

FIG. 2 is a detailed diagram of the FIG. 1 embodiment;

FIG. 5 is a diagram of a prior art reference voltage generator; and

FIG. 6 is a detailed diagram of a tuning circuit for the $V_{REF}$ transistor shown in FIG. 2.

DETAILED DESCRIPTION OF THE PREFERRED EMBODIMENT

Figure 3:
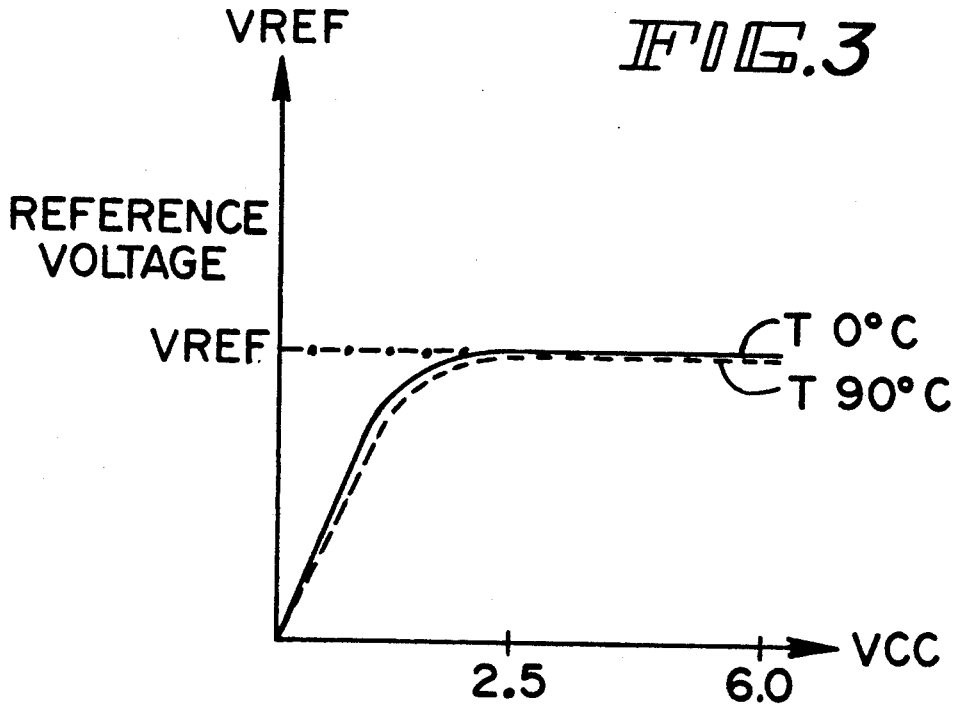
FIG. 3 is a graph showing the stability of the generated reference voltage over a $V_{CC}$ range for the FIG. 1 embodiment.

FIG. 1 shows a circuit 10 embodying the present invention. A constant current source 2, coupled to receive a first power supply voltage $V_{CC}$, supplies a constant current I to a transistor 6. A voltage drop between a node 4 and a node 8 (across transistor 6) generates a reference voltage $V_{REF}$ at node 4. Node 8 is coupled to receive a second (power supply) voltage, preferably $V_{SS}$. Preferably but not necessarily circuit 10 is located on an integrated circuit.

FIG. 2 is a detailed diagram of a preferred embodiment of such a circuit 10. A first node 12 and a first electrode 14*a* of a resistor 14 are preferably coupled to a voltage $V_{CC}$. Although FIG. 2 shows them coupled together by line 15, it is possible to couple node 12 to $V_{cc}$ at one connection and to couple the (first) electrode 14*a* of resistor 14 to $V_{cc}$ at a second connection. A source electrode of a preferably P-channel metal oxide semiconductor ("MOS") field-effect transistor ("FET") 16 is also preferably coupled to first node 12. A second electrode of resistor 14, a gate electrode of transistor 16, and a source electrode of another P-channel MOS FET 18 are coupled to a second node 20. A drain electrode of transistor 16 and a gate electrode of transistor 18 are coupled to a third node 22. A first electrode 24*a* of a second resistor 24 is connected to third node 22 and a second electrode 24*b* of resistor 24 is connected to a second potential (e.g. ground potential). A fourth node 26 is illustratively coupled to a drain electrode of transistor 18 and a source electrode of a MOS FET 28. Also, $V_{REF}$ is preferably output at fourth node 26. A gate electrode and a drain electrode of transistor 28 are preferably coupled to a fifth node 30, which is also preferably coupled to second potential (e.g. ground potential).

Thus, it will be seen that paths from $V_{CC}$ to ground are: (1) via the source-drain path of FET 16 and then resistor 24, and (2) via resistor 14 and then the source-drain paths of FETs 18 and 28.

The use of resistors 14 and 24 with values preferably in the 100-500 kΩ range will decrease the amount of current through the circuit. This in turn will reduce the power consumption. Also, it is preferred that transistor 16 have a larger channel width to length ratio than transistors 18 and 28. For example, transistor 16 can have such a ratio of 200:1, transistor 18 can have a ratio of 4:10 and transistor 28 can have a ratio of 2.2:10 while resistors 14 and 24 can be 500 kΩ.

The operation of the FIG. 2 embodiment will now be discussed. Reference may be had to Mobley and Eaton, Jr. U.S. Pat. No. 5,134,310 entitled "Current Supply Device For Driving High Capacitance Load In An Integrated Circuit," issued Jul. 28, 1992, for a description of a similar configuration used in another application, however, without FET 28 and connections 36 (explained infra). The circuit in FIG. 2 is preferably configured so that the voltage difference between nodes 20 and 22 will remain the same when $V_{cc}$ varies. $V_{cc}$ preferably varies at a greater rate than the variances of nodes 20 and 22. It is preferred that transistors 16, 18 and 28 are biased to their saturation regions so that the current between transistors 16, 18 and 28 source-to-drain path is given by the equation:

$$I_{DS}=\beta W/L(V_{GS}-V_T)^2 \quad (2)$$

where $\beta$ is a constant which is equal to the capacitance of the oxide multiplied by the mobility of the current carriers of a saturated transistor, W is the channel width of a transistor, L is the channel length of the transistor, $V_{GS}$ is the voltage difference between the gate and source of the transistor, and $V_T$ is the threshold voltage of the transistor.

When $V_{cc}$ increases, the voltage at node 20 increases in such a manner that the voltage difference ($V_{GS}$ of transistor 16) between nodes 12 and 20 increases, thereby increasing the source-to-drain current $I_{16}$ of transistor 16 as calculated by Equation 2. Increased current $I_{16}$ causes the voltage at node 22 to increase simultaneously with node 20, which maintains the voltage difference ($V_{GS}$ of transistor 18) between nodes 20 and 22 substantially the same. Thus, the current $I_{18}$ is substantially unchanged as calculated by Equation 2.

Conversely, as $V_{cc}$ decreases, the voltage at node 20 decreases in such a manner that the voltage difference between nodes 12 and 20 decreases, thereby decreasing current $I_{16}$. Decreased current $I_{16}$ causes the voltage at node 22 to decrease along with the decreasing voltage of node 20. The voltage difference between nodes 20 and 22 of transistor 18 remains the same which maintains the current $I_{18}$ substantially unchanged as calculated by Equation 2.

The constant current $I_{18}$ flows through transistor 28 which is preferably biased by connecting its gate and source electrodes together. This leaves transistor 28 in a preferred saturation mode. With transistor 28 in saturation, its resistance is held constant. Therefore, the constant current flowing through saturated transistor 28 causes a constant voltage drop and, hence, a stable $V_{REF}$ available at node 26.

FIG. 3 illustrates the value of reference voltage $V_{REF}$ as $V_{CC}$ varies. The portion of FIG. 3 with a positive slope indicates that transistor 28 is in its linear region. The portion with the approximately zero slope (i.e., where transistor 28 is in saturation) shows that the preferred embodiment of the present invention will maintain $V_{REF}$ a substantially constant value when $V_{CC}$ varies between approximately 2.5 volts and 6.0 volts. As also can be seen in FIG. 3, $V_{REF}$ is substantially maintained at varying temperatures, illustratively shown for 0° C. (solid line) and 90° C. (dashed line).

If $V_{CC}$ decreases below 2.3 volts, transistor 28 will leave saturation and enter its linear region. Any $V_{CC}$ fluctuations while transistor 28 is in the linear region will vary its resistance. As a result, $V_{REF}$ would also vary. Various transistor types and dimensions, along with the variation of other components of the circuit will alter the voltage range over which the circuit will generate a stable $V_{REF}$.

Figure 4:
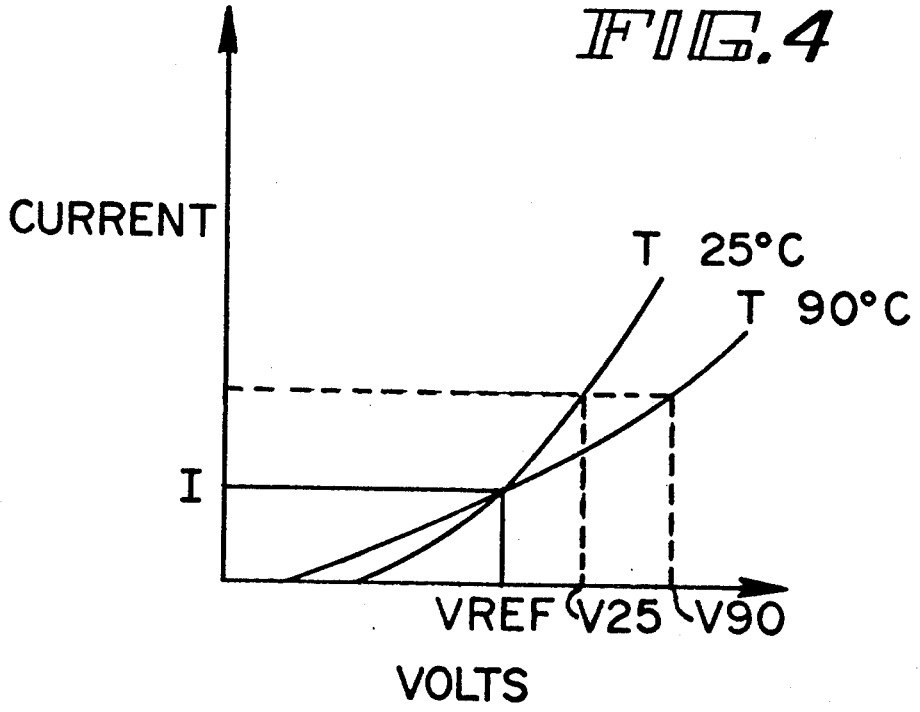
FIG. 4 is a graph of the bias region for the preferred biased P-channel transistor of the FIG. 1 embodiment where $V_{DS}$ (drain-to-source voltage) is substantially equal over a temperature range.

FIG. 4 shows the I-V characteristics of transistor 28. The two lines of FIG. 4 illustrate the inverse resistance (1/R) of transistor 28 for two temperatures (illustratively 25° C. and 90° C.). The intersection of these lines is the transistor 28 bias region where $V_{DS}$ (drain-to-source voltage) is substantially equal over a temperature range. This bias region corresponds to the transistor resistance where a constant current supplied to the transistor will cause a voltage drop that does not vary with temperature. When a current, illustratively I in FIG. 4, is supplied to transistor 28, $V_{REF}$ remains substantially stable regardless of temperature fluctuations within or about the range from 25° to 90° centigrade. If the current supplied to transistor 28 were to increase, illustratively shown in FIG. 4 by the dashed lines, it would intersect the lines representing 25° C. and 90° C. at different respective $V_{REF}$. Hence the need for biasing the constant current source in the appropriate region to avoid temperature variations.

In Equation 2, $\beta=\mu C_{OX}$, where $\mu$ is the mobility carrier constant at a given temperature, $C_{OX}$ is the capacitance of the gate oxide and $VGS=-V_{REF}$. The mobility carrier constant decreases with increases in temperature. The threshold voltage $V_T$ also decreases with increases in temperature. The parenthetical quantity of Equation 2 increases when $V_T$ decreases. Hence, the I-V curves T25 and T90 exhibit exponential characteristics.

As shown in FIG. 4, it is important to supply a current to transistor 28 which will generate a substantially constant VREF regardless of temperature. To show that such a current exists, the following equations are required:

$$I_{DS25} = \mu_{25} C_{OX} \frac{W}{L} (V_{GS} - V_{T25})^2 \quad (3)$$

$$I_{DS90} = \mu_{90} C_{OX} \frac{W}{L} (V_{GS} - V_{T90})^2 \quad (4)$$

where $\mu_{25}$ and $\mu_{90}$ are the mobility constants for temperatures 25° C. and 90° C., respectively, $V_{T25}$ and $V_{T90}$ are the threshold voltages for temperatures 25° C. and 90° C., respectively, and $I_{DS25}$ and $I_{DS90}$ are the drain to source current for temperatures 25° C. and 90° C., respectively.

By setting $I_{DS25}=I_{DS90}$ (current $I_{18}$ is substantially constant for all temperatures) the following equation is obtained:

$$(\mu_{25}-\mu_{90})(V_{GS})^2+(-\mu_{25}2V_{T25}+\mu_{90}2V_{T90})V_{GS}-\mu_{90}(V_{T90})^2+\mu_{25}(V_{T25})^2=0 \quad (5)$$

Since Equation 5 is a quadratic equation, a value for $V_{GS}$ can be found which remains substantially constant for the constant current. Other values calculated for $V_{GS}$ using other temperatures will be approximately equal. Therefore, a substantially constant $V_{REF}$ will be generated for varying temperatures by supplying a corresponding constant current $I_{18}$ to transistor 28.

Essentially, the carrier mobility variable $\mu$ and $V_T$ compensate for each other's changes as the temperature changes, thus allowing lines $T_{25}$ and $T_{90}$ to intersect. This self-compensation allows for other temperature lines (not shown) to intersect at approximately the same point at lines $T_{25}$ and $T_{90}$. Thus, supplying a constant current to transistor 28 will generate a substantially constant voltage $V_{REF}$ regardless of temperature changes due to the self-compensation of the carrier mobility variable $\mu$ and $V_T$ upon each other.

The temperature coefficients of the resistors used in the preferred embodiment can be also utilized to further compensate for temperature variations. For example, a resistor having a negative temperature coefficient (decreased resistance with increased temperature) will allow more current to flow when the temperature increases because of its decreased resistance. This in turn would supply more current to transistor 28 and would generate a greater $V_{REF}$. As seen in FIG. 3, a greater $V_{REF}$ at an increased temperature, for example 90° C., would move the dashed line closer to the line representing 0° C.

It is also preferred that the substrate of transistors 16, 18 and 28 should be biased to a voltage equivalent to their source voltage (as shown by wirings 36 in FIG. 2). This is done to eliminate a body effect. Body effect is the characteristic shift in threshold voltage resulting from the bias difference from the source to its substrate. If there is a high body effect, the threshold voltage increases. If there is a low body effect, the threshold voltage decreases. Biasing the substrate with a voltage equivalent to that of the source eliminates the body effect which causes variations in the threshold voltage of the preferred embodiment.

Depending on the circuit application of $V_{REF}$, it may be necessary to tune $V_{REF}$ to the desired value in order to compensate for variations in $V_T$ and other process parameters such as mobility. To accomplish tuning of $V_{REF}$, it is preferable that when the embodiment of FIG. 2 is fabricated, not just one transistor 28 but multiple such transistors are created between node 26 and ground ($V_{SS}$), as shown in FIG. 6. Upon testing, the transistor or transistors that generate the required $V_{REF}$ are chosen and will then operate as transistor 28. The other transistors will be configured to be inactive.

In FIG. 6, source electrodes of P-channel tuning transistors 50, 52, 54 and 56 are coupled to node 26. Gate and drain electrodes of tuning transistors 50, 52, 54 and 56 are coupled to drain electrodes of N-channel transistors 58, 60, 62 and 64, respectively. The gate electrodes of transistors 58, 60, 62 and 64 are coupled to receive signals A, B, C and D, respectively, which are supplied from an external source (not shown). Source electrodes of transistors 58, 60, 62 and 64 are preferably coupled to the second potential. Transistors 50, 52, 54 and 56 also have their sources coupled to their substrate (shown by wirings 66 in FIG. 6).

It is preferred that tuning transistors 50, 52, 54 and 56 have a channel width to length ratio determined by the equation:

$$\frac{W_n}{L_n} = K^{n-1} \frac{W_1}{L_1} \quad (6)$$

where n equals the number of tuning transistors, $W_n$ is the width of the channel of transistor n, $L_n$ is the length of the channel of transistor n, K is a constant which sets the minimum difference between the tuning transistors width to length ratios, and $W_1/L_1$ is the width to length ratio of the transistor that is used as a reference from which the other width to length ratios are determined. A large K will cover a broad range of $V_{REF}$ variations, but the tuning will be more coarse because small incremental changes in $V_{REF}$ will not be possible. Therefore, K should be picked to be as small as possible, but large enough to cover the worst case variations of $V_{REF}$.

The tuning of $V_{REF}$ will now be explained with reference to FIG. 6. During testing, transistors 58, 60, 62 and 64 will turn on when they receive their respective signal A, B, C and D as active. Once on, transistors 58, 60, 62 and 64 will create a path from node 26, through transistors 50, 52, 54 and 56, respectively, to the second potential ($V_{SS}$). Tuning transistors 50, 52, 54 and 56 activated by various combinations of signals A, B, C and D creates various voltage drops at node 26, and the desired value of $V_{REF}$ can be achieved.

After a combination of signals A, B, C and D is selected, a preferred fuse circuit, preferably on the chip with the present invention, is configured to maintain the selected combination of signals A, B, C and D. Other types of circuitry may be used to render permanently conductive the selected combination.

One skilled in the art will appreciate that the P- and N-channel transistors used in FIG. 6 may be replaced by other types of transistors. The number of tuning transistors used in FIG. 6 is illustrative only, and the number of tuning transistors used can depend on the degree of accuracy needed for tuning $V_{REF}$ or the range of variation of $V_{REF}$ expected from the variations in $V_T$ or the other process parameters.

One skilled in the art will appreciate too that resistors 14 and 24 may be replaced with other devices that impart resistance. Transistors are one example.

It will be appreciated that the foregoing description is directed to a preferred embodiment of the present invention and that numerous modifications or alterations can be made without departing from the spirit or scope of the present invention.

What is claimed as the invention is:

1. A reference voltage generator comprising:

a first node coupled to receive a first supply voltage;

a first resistance device having a first electrode coupled to receive said first supply voltage, and having a second electrode coupled to a second node;

a first transistor with a first electrode coupled to said first node, a second electrode coupled to a third node and a control electrode coupled to said second node;

a second transistor having a first electrode coupled to said second node, a second electrode coupled to a fourth node and a control electrode coupled to said third node;

a second resistance device having a first electrode coupled to said third node and a second electrode coupled to a second potential; and a third transistor having a first electrode coupled to said fourth node, a second electrode, and a control electrode coupled to said second potential, wherein a reference voltage is available at said fourth node.

2. A reference voltage generator according to claim 1 wherein said first and second resistance devices are resistors.

3. A reference voltage generator according to claim 1 wherein first, second and third transistors are P-channel field effect transistors.

4. A reference voltage generator according to claim 1 wherein said third transistor is biased to saturation.

5. A reference voltage generator according to claim 1 wherein said first electrode and a substrate of said respective first, second and third transistors have equal potential.

6. A reference voltage generator according to claim 1 wherein said first and second resistance devices have negative temperature coefficients.

7. A reference voltage generator according to claim 1 wherein said first, second and third transistors each have a channel, wherein said channel of said first transistor has a substantially greater width to length ratio than said channels of said second and third transistors.

8. A reference voltage generator according to claim 2 wherein the ohmic value of each said first and second resistors is in the range of 100 to 500 kΩ, inclusive.

9. A reference voltage generator according to claim 1 wherein said third transistor is selected from a plurality of transistors coupled to said fourth node in parallel.

10. A reference voltage generator according to claim 1 wherein said reference generator is an integrated circuit.

11. A reference voltage generator according to claim 1 wherein said third transistor is operated in a region where a carrier mobility and a threshold voltage of said third transistor are self-compensating so that temperature changes do not substantially change said reference voltage.

12. The generator of claim 1 wherein said third transistor has a gate electrode and a drain electrode, and said electrodes are shorted together.

13. The generator of claim 1 wherein said transistors include a P-channel FET.

14. The generator of claim 3 wherein each of said P-channel transistors has its source electrode coupled to a substrate or region containing said transistor.

15. A reference voltage generator comprising:

a constant current source and a transistor, the constant current source being substantially constant over changes in operating voltage and temperature, the transistor being configured to operate in a region where a carrier mobility and a threshold voltage of said transistor are self-compensating so that temperature changes do not substantially change said reference voltage.

16. A method of manufacturing a reference voltage generator comprising the steps of:

providing a constant current source circuit to supply a constant current to a node, and coupling a plurality of transistors to said node in parallel;

coupling a control signal circuit to said transistors, the control circuit being operable to output selectively one or more electrical control signals to said transistors;

operating said control signal circuit to produce one or more of said electrical control signals for one or more of said transistors, so that said transistors are selectively activated thereby to generate a selected reference voltage at said node according to said constant current.

17. A method for generating a reference voltage comprising the steps of:

via a first node, supplying a supply voltage to a first transistor and a first resistor;

controlling said first transistor by a second node voltage wherein said second node voltage is responsive to a variation of said supply voltage;

controlling a second transistor from a third node wherein a third node voltage is responsive to a variation of said supply voltage, and maintaining a current through said second transistor substantially constant;

coupling a control electrode of a third transistor to a drain electrode of said third transistor; and supplying said current to said third transistor thereby to generate a stable reference voltage at a fourth node.

18. A method of generating a reference voltage according to claim 17 wherein said current corresponds to a bias region of said third transistor where said constant current supplied to said third transistor will cause a voltage drop that does not vary with temperature.

19. A method for generating a reference voltage according to claim 17 further comprising the step of biasing said third transistor to saturation wherein a resistivity of said third transistor is a constant.

* * * * *